US010553984B2

(12) United States Patent
An et al.

(10) Patent No.: US 10,553,984 B2
(45) Date of Patent: Feb. 4, 2020

(54) PLUG JACK OF TERMINAL DEVICE FOR EXTERNAL COMPONENT AND TERMINAL DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Na An, Beijing (CN); Nan Liu, Beijing (CN); Gang Ci, Beijing (CN); Hao Wu, Beijing (CN); Baolei Guo, Beijing (CN); Xinfeng Gong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/512,587

(22) PCT Filed: Jul. 27, 2016

(86) PCT No.: PCT/CN2016/091862
§ 371 (c)(1),
(2) Date: Mar. 20, 2017

(87) PCT Pub. No.: WO2017/152568
PCT Pub. Date: Sep. 14, 2017

(65) Prior Publication Data

US 2018/0366863 A1 Dec. 20, 2018

(30) Foreign Application Priority Data

Mar. 8, 2016 (CN) ..... 2016 1 0131379

(51) Int. Cl.
*H01R 13/52* (2006.01)
*H01R 13/648* (2006.01)

(52) U.S. Cl.
CPC ..... *H01R 13/52* (2013.01); *H01R 13/6485* (2013.01); *H01R 2201/16* (2013.01)

(58) Field of Classification Search
CPC .... H01R 24/58; H01R 13/7031; H01R 24/76; H01R 13/6585; H01R 24/40;
(Continued)

(56) References Cited

U.S. PATENT DOCUMENTS 5,222,899 A 6/1993 Hulderman
5,499,935 A * 3/1996 Powell ..... H01R 13/66 439/182
(Continued)

FOREIGN PATENT DOCUMENTS

CN 2703382 Y 6/2005
CN 2779751 Y 5/2006
(Continued)

OTHER PUBLICATIONS

Third Office Action for Chinese Application No. 201610131379.9, dated Nov. 27, 2018, 6 Pages.
(Continued)

*Primary Examiner* — Xuong M Chung Trans
(74) *Attorney, Agent, or Firm* — Brooks Kushman P.C.

(57) ABSTRACT

A plug jack of a terminal device for an external component and a terminal device are provided. The plug jack of a terminal device for an external component includes a slot provided with a mouth, and a conductive layer connected to a low level is arranged on an inner wall of the slot.

10 Claims, 2 Drawing Sheets

(58) Field of Classification Search
CPC ..... H01R 13/5202; H01R 13/193; H01R 13/639; H01R 13/719; H01R 43/26; H01R 13/523
See application file for complete search history.

(56) References Cited

U.S. PATENT DOCUMENTS

| | | | | |
|---|---|---|---|---|
| 5,669,789 | A * | 9/1997 | Law | H01R 13/719 333/12 |
| 6,106,314 | A * | 8/2000 | McLean | H01R 13/7032 200/51.1 |
| 9,960,542 | B2 * | 5/2018 | Holland | H01R 13/6581 |
| 2012/0134525 | A1 | 5/2012 | Chai et al. | |
| 2015/0092972 | A1 | 4/2015 | Lai et al. | |
| 2016/0164217 | A1 | 6/2016 | Lee | |

FOREIGN PATENT DOCUMENTS

| | | | |
|---|---|---|---|
| CN | 1794903 | A | 6/2006 |
| CN | 201266738 | Y | 7/2009 |
| CN | 201699237 | U | 1/2011 |
| CN | 201985928 | U | 9/2011 |
| CN | 202004277 | U | 10/2011 |
| CN | 202094956 | U | 12/2011 |
| CN | 102904117 | A | 1/2013 |
| CN | 103124022 | A | 5/2013 |
| CN | 203456642 | U | 2/2014 |
| CN | 204117921 | U | 1/2015 |
| CN | 104466518 | A | 3/2015 |
| CN | 104916960 | A | 9/2015 |
| CN | 105794223 | A | 7/2016 |
| JP | 2015082431 | A | 4/2015 |
| TW | M497868 | U | 3/2015 |

OTHER PUBLICATIONS

First Office Action for Chinese Application No. 201610131379.9, dated Sep. 5, 2017, 6 Pages.
International Search Report and Written Opinion for Application No. PCT/CN2016/09862, dated Dec. 7, 2016, 9 Pages.
International Search Report and Written Opinion for Application No. PCT/CN2016/091862, dated Dec. 7, 2016, 9 Pages.

* cited by examiner

PLUG JACK OF TERMINAL DEVICE FOR EXTERNAL COMPONENT AND TERMINAL DEVICE

CROSS-REFERENCE TO RELATED APPLICATIONS

This application is the U.S. national phase of PCT Application No. PCT/CN2016/091862 filed on Jul. 27, 2016, which claims priority to Chinese Patent Application No. 201610131379.9 filed on Mar. 8, 2016, the disclosures of which are incorporated in their entirety by reference herein.

TECHNICAL FIELD

The present disclosure relates to the field of terminal device, and in particular to a plug jack of a terminal device for an external component and a terminal device.

BACKGROUND

A plug jack of a cell phone for an external component (such as a headphone, a USB etc.) in a related art includes a slot connected to a mainboard of the cell phone. The plug jack such as a headphone jack and a USB jack of the cell phone is a weak link in a static test and in a practical use. In the static test or the practical use, statics may enter into the mainboard of the cell phone easily through the plug jack, and then the cell phone may suffer a variety of display related problems. Meanwhile, due to the headphone jack or the USB jack of the cell phone, an internal circuit of the cell phone is in communication with the external environment of the cell phone. When the cell phone is wet by water, the water may infiltrate into the cell phone directly via the slot, which causes a short circuit and a corrosion of the internal circuit of the cell phone and results in damages on the cell phone.

At present, in order to prevent water from entering into the cell phone through the plug jack, the cell phone is usually added with a waterproof cell phone shell. However, it is unable to touch the cell phone when using the same, so the cell phone may not be convenient to be used. Alternatively, the headphone jack or the USB jack of the cell phone is added with a waterproof plug. However, the plug jack may not be convenient to be used due to the waterproof plug, and the waterproof plug is easy to be lost and has a poor anti-static performance in cell phone manufacturer's static tests.

SUMMARY

A plug jack of a terminal device for an external component and a terminal device are provided in the present disclosure, so as to improve the anti-static performance of the plug jack of a terminal device for an external component in a static test or a practical use in compared with the related art.

The present disclosure provides the following technical solution.

A plug jack of a terminal device for an external component is provided, including a slot provided with a mouth and a conductive layer, where the conductive layer is arranged on an inner wall of the slot.

Further, the conductive layer is arranged at a side of the slot away from the mouth.

Further, the slot is blocked by the conductive layer at the side of the slot away from the mouth.

Further, a mainboard of the terminal device is provided with a ground component, and the conductive layer is electrically connected to the ground component of the mainboard of the terminal device.

Further, a waterproof layer is arranged on the inner wall of the slot.

Further, the waterproof layer is arranged at an outer side of the conductive layer in such a manner as to expose at least a part of the conductive layer.

Further, the waterproof layer is arranged at a side of the slot away from the mouth.

Further, the slot is blocked by the waterproof layer at a side of the slot away from the mouth.

Further, the conductive layer is arranged between the waterproof layer and the inner wall of the slot and at a side of the waterproof layer away from the mouth.

Further, the conductive layer is grounded.

A terminal device is further provided, including the above mentioned plug jack for an external component.

The present disclosure has the following beneficial effects.

According to the plug jack of a terminal device for an external component provided in the present disclosure, the conductive layer arranged on the inner wall of the slot may prevent the static interference, thereby the anti-static performance of the plug jack of a terminal device for an external component in a static test or practical use may be improved in compared with the prior art. In addition, according to the plug jack of a terminal device for an external component provided in the present disclosure, a waterproof layer arranged on the inner wall of the slot may prevent the water in the slot from entering into the mainboard of the cell phone to avoid the short circuit and corrosion of the mainboard. The plug jack of a terminal device for an external component provided in the present disclosure ensures that the terminal device may be normally used after subjecting to a static interference or being wet by water, without affecting the service life of the terminal device.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art may obtain the other embodiments, which also fall within the scope of the present disclosure.

Figure 1:
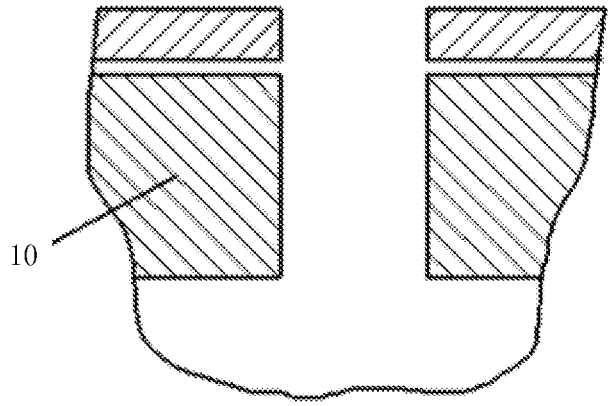
FIG. 1 is a schematic diagram showing a plug jack of a terminal device for an external component in the related art.

FIG. 1 is a sectional view of a plug jack of a cell phone for an external component in the related art. The plug jack of a cell phone for an external component (such as a headphone, a USB) in the related art includes a slot 10 connected to a mainboard of the cell phone. T plug jack (such as a cell phone headphone jack or a USB jack) is a weak link in a static test and in a practical use. In a static test or practical use, statics may enter into the mainboard of the cell phone easily through the plug jack, and then the cell phone may suffer a variety of display related problems. Meanwhile, due to the headphone jack or the USB jack of the cell phone, an internal circuit of the cell phone is in communication with the external environment of the cell phone. When the cell phone is wet by water, the water may infiltrate into the cell phone directly via the slot, which causes a short circuit and a corrosion of the internal circuit of the cell phone, and results in damages on the cell phone.

In view of the poor anti-static performance of the plug jack of a terminal device for an external component in a static test or practical use in the related art, a plug jack of a terminal device for an external component is provided in the present disclosure, so as to improve the anti-static performance of the plug jack of a terminal device for an external component in a static test or practical use in compared with the related art.

Figure 2:
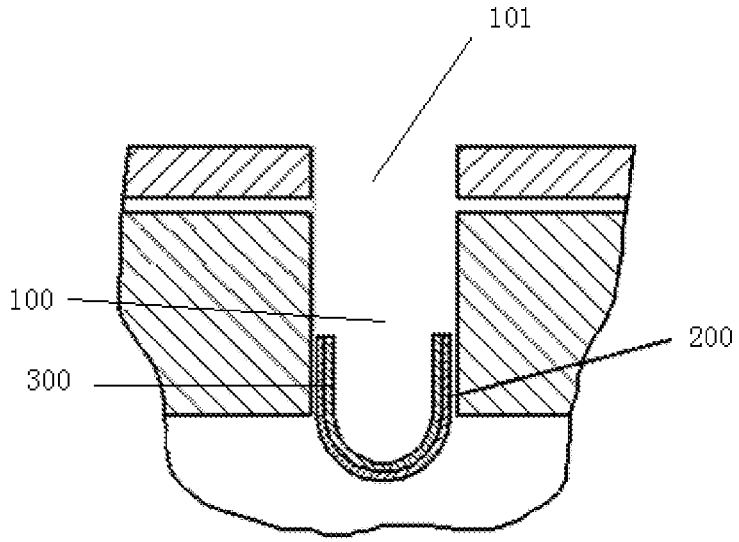
FIG. 2 is a schematic diagram showing a plug jack of a terminal device for an external component provided in some embodiments of the present disclosure.

As shown in FIG. 2, the plug jack of a terminal device for an external component provided by the present disclosure includes a slot 100 provided with a mouth 101, and a conductive layer 200 connected to a low level is arranged on an inner wall of the slot 100.

According to the above embodiment, the conductive layer 200 connected to the low level (i.e., grounded) and arranged on the inner wall of the slot 100 may prevent statics from damaging internal components of the terminal device.

It should be noted that, the terminal device provided by the present disclosure may be any terminal devices, such as a cell phone, a tablet PC, and the external component of the terminal device may be a headphone, a USB, etc. Accordingly, the plug jack of a terminal device for an external component may be a headphone jack, a USB jack and the like, or other types of plug jack by which the inner mainboard of the terminal device is in communication with the external environment.

In some embodiments of the present disclosure, the conductive layer 200 is arranged at a side of the slot 100 away from the mouth 101, as shown in FIG. 2.

According to the above embodiment, for the plug jack of a terminal device for an external component such as a headphone jack of a cell phone, in order to avoid the conductive layer 200 from being in contact with the external component of the plug jack to affect functions thereof, in the embodiment, the conductive layer 200 is arranged at the side of the slot 100 away from the mouth 101. When the external component is plugged in the slot 100, the external component will not be in contact with the conductive layer 200.

In addition, in some embodiments of the present disclosure, the slot 100 is blocked by the conductive layer 200 at the side of the slot 100 away from the mouth 101, as shown in FIG. 2.

As shown in FIG. 2, taking a headphone jack of a cell phone as an example, one end of the slot 100 is the mouth 101, and the other end of the slot 100 is an opening in communication with the mainboard of the cell phone. According to the above embodiment, the conductive layer 200 is designed to block the slot 100 at the side thereof away from the mouth 101, thereby preventing foreign matters such as liquid from entering into the cell phone.

Figure 3:
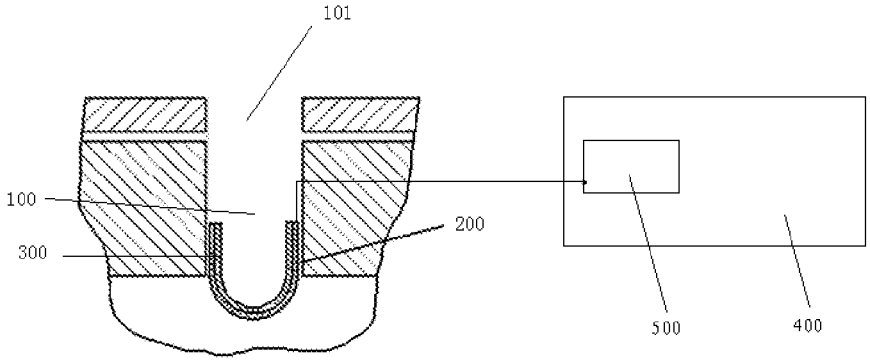
FIG. 3 is a schematic diagram showing an electrical connection between a conductive layer in a plug jack of a terminal device for an external component and a ground component of a mainboard of the terminal device provided in some embodiments of the present disclosure.

In addition, as shown in FIG. 3, in some embodiments of the present disclosure, a mainboard 400 of the terminal device is provided with a ground component 500, and the conductive layer 200 is electrically connected to the ground component 500 of the mainboard 400 of the terminal device.

According to the above embodiment, the conductive layer 200 is electrically connected to the ground component of the mainboard of the terminal device, thereby grounding the conductive layer 200.

In addition, the slot of a terminal device for an external component (such as a headphone, a USB) in the related art is in communication with a mainboard of the terminal device, and there is no structure for isolating the mainboard of the terminal device from the external liquid, therefore water may enter into the mainboard through the slot, and damage the mainboard and the terminal device.

In view of this, in some embodiments of the present disclosure, as shown in FIG. 2, a waterproof layer 300 is arranged on the inner wall of the slot 100 so as to prevent water from entering into the terminal device.

In some embodiments of the present disclosure, the waterproof layer 300 is arranged at an outer side of the conductive layer 200 in such a manner as to expose at least a part of the conductive layer 200.

According to the above embodiment, the waterproof layer 300 is arranged at the outer side of the conductive layer 200, thereby protecting the conductive layer 200 from being corroded.

Optionally, the waterproof layer 300 is arranged at the side of the slot 100 away from the mouth 101.

According to the above embodiment, for the plug jack of a terminal device for an external component such as a headphone jack of a cell phone, in order to avoid the conductive layer 200 from being in contact with the external component of the plug jack to affect functions thereof, in some embodiments of the present disclosure, the conductive layer 200 is arranged at the side of the slot 100 away from the mouth 101. When the external component is plugged in the slot 100, the external component will not be in contact with the waterproof layer 300.

In some embodiments of the present disclosure, the slot 100 is blocked by the waterproof layer 300 at the side of the slot 100 away from the mouth 101.

According to the above embodiment, the conductive layer 200 is designed to block the slot 100 at the side thereof away from the mouth 101, thereby preventing foreign matters such as liquid from entering into the cell phone.

It should be noted that, in the plug jack of a terminal device for an external component provided in some embodiments of the present disclosure, the conductive layer 200 and the waterproof layer 300 may be coated onto the inner wall of the slot 100, thereby isolating the mainboard of the terminal device from the external environment and prevent liquids from entering therein. Firstly, a conductive layer 200 is coated for grounding to prevent statics from damaging the component in the cell phone, and then a waterproof layer 300 is coated to isolate the internal structure of the cell phone from the external environment, thereby preventing water from entering into the cell phone.

A terminal device is further provided in some embodiments of the present disclosure, including the above mentioned plug jack for an external component.

The above are merely a part of the embodiments of the present disclosure. It should be noted that, a person skilled in the art may make improvements and modifications without departing from the principle of the present disclosure, and these improvements and modifications shall also fall within the scope of the present disclosure.

What is claimed is:

1. A plug jack of a terminal device for an external component, comprising a slot provided with a mouth and a conductive layer, wherein the conductive layer is arranged on an inner wall of the slot, the conductive layer is arranged at a side of the slot away from the mouth, and the slot is blocked by the conductive layer at the side of the slot away from the mouth, a waterproof layer is arranged on the inner wall of the slot, the waterproof layer is arranged at an outer side of the conductive layer in such a manner as to expose at least a part of the conductive layer, the slot is blocked by the waterproof layer at a side of the slot away from the mouth.

2. The plug jack according to claim 1, wherein a mainboard of the terminal device is provided with a ground component, and the conductive layer is electrically connected to the ground component of the mainboard of the terminal device.

3. The plug jack according to claim 1, wherein the waterproof layer is arranged at a side of the slot away from the mouth.

4. The plug jack according to claim 1, wherein the conductive layer is arranged between the waterproof layer and the inner wall of the slot and at a side of the waterproof layer away from the mouth.

5. The plug jack according to claim 1, wherein the conductive layer is grounded.

6. A terminal device, comprising a plug jack for an external component, wherein the plug jack comprises a slot provided with a mouth and a conductive layer, wherein the conductive layer is arranged on an inner wall of the slot, the conductive layer is arranged at a side of the slot away from the mouth, and the slot is blocked by the conductive layer at the side of the slot away from the mouth, a waterproof layer is arranged on the inner wall of the slot, the waterproof layer is arranged at an outer side of the conductive layer in such a manner as to expose at least a part of the conductive layer, the slot is blocked by the waterproof layer at a side of the slot away from the mouth.

7. The terminal device according to claim 6, wherein a mainboard of the terminal device is provided with a ground component, and the conductive layer is electrically connected to the ground component of the mainboard of the terminal device.

8. The terminal device according to claim 6, wherein the waterproof layer is arranged at a side of the slot away from the mouth.

9. The terminal device according to claim 6, wherein the conductive layer is arranged between the waterproof layer and the inner wall of the slot and at a side of the waterproof layer away from the mouth.

10. The terminal device according to claim 6, wherein the conductive layer is grounded.

* * * * *